US007045940B2

(12) United States Patent
Ko et al.

(10) Patent No.: US 7,045,940 B2
(45) Date of Patent: May 16, 2006

(54) HOLDER FOR CATHODE RAY TUBE AND FABRICATION METHOD THEREOF

(75) Inventors: Min-Hee Ko, Kumi (KR); Sang-Hyung Kang, Kumi (KR)

(73) Assignee: LG. Philips Displays Korea Co., Ltd., Kyeongsangbuk-do (KR)

( * ) Notice: Subject to any disclaimer, the term of this patent is extended or adjusted under 35 U.S.C. 154(b) by 232 days.

(21) Appl. No.: 10/640,653

(22) Filed: Aug. 14, 2003

(65) Prior Publication Data

US 2004/0229521 A1 Nov. 18, 2004

(30) Foreign Application Priority Data

May 12, 2003 (KR) ..... 2003/29877

(51) Int. Cl.
*H01J 29/80* (2006.01)

(52) U.S. Cl. ..... 313/402; 267/158; 267/159; 267/160; 313/404; 313/405; 313/406

(58) Field of Classification Search ..... 313/402, 313/404, 405, 406; 439/894; 267/158, 159, 267/160

See application file for complete search history.

(56) References Cited

U.S. PATENT DOCUMENTS

| | | | | |
|---|---|---|---|---|
| 3,334,259 | A * | 8/1967 | Shrader | 313/406 |
| 4,491,763 | A * | 1/1985 | Fujinuma et al. | 313/405 |
| 5,717,280 | A * | 2/1998 | Lee | 313/404 |
| 5,914,557 | A * | 6/1999 | Tai et al. | 313/407 |
| 6,057,641 | A * | 5/2000 | Yoshida et al. | 313/404 |
| 2001/0013749 | A1 * | 8/2001 | Seo | 313/407 |

FOREIGN PATENT DOCUMENTS

| | | |
|---|---|---|
| JP | 2-79332 A | 3/1990 |
| JP | 4-179030 A | 6/1992 |

* cited by examiner

*Primary Examiner*—Ashok Patel
(74) *Attorney, Agent, or Firm*—Birch Stewart Kolasch & Birch LLP

(57) ABSTRACT

A holder for a cathode ray tube includes a stud engaging portion having an engaging hole in order to be engaged to a stud pin mounted inside a panel, a frame engaging portion engaged to a mask frame which supports a shadow mask, and a connecting portion for connecting the stud engaging portion and the frame engaging portion. Lower end surfaces of a pair of holders are arranged facing toward each other so that the lower end surfaces of the connecting portion are in substantial contact with each other.

18 Claims, 8 Drawing Sheets

HOLDER FOR CATHODE RAY TUBE AND FABRICATION METHOD THEREOF

This nonprovisional application claims priority under 35 U.S.C. §119(a) on Patent Application No(s). 29877/2003 filed in Korea on May 12, 2003, which is(are) herein incorporated by reference.

BACKGROUND OF THE INVENTION

1. Field of the Invention

The present invention relates to a holder for a cathode ray tube and a fabrication method thereof, and more particularly, to a holder and a fabrication method thereof for a cathode ray tube which can reduce fabrication costs by integrally forming a pair of holders during a punching process for forming the holder. Accordingly, the generation of unwanted scrap is prevented during the fabrication of the holder.

2. Description of the Background Art

A cathode ray tube is a device for converting an electric signal into an electron beam and emitting the electron beam to a phosphor screen to realize an image. The cathode ray tube is widely used in the background art since excellent display quality is achieved at an affordable price. However, the present inventors have determined that the devices of the background art suffer from the following disadvantages.

A cathode ray tube will be explained with reference to attached drawings. FIG. 1 is a schematic view showing an example of a cathode ray tube of the background art. As shown in FIG. 1, the cathode ray tube includes a panel 1 of a front glass; a funnel 2 of a rear glass engaged to the panel 1 for forming a vacuum space; a phosphor screen 4 deposited on an inner surface of the panel 1 and serving as a phosphor; an electron gun 12 for emitting an electron beam 6 which makes the phosphor screen 4 emit light; a deflection yoke 5 mounted at an outer circumference surface of the funnel 2 with a predetermined interval for deflecting the electron beam 6 to the phosphor screen 4; a shadow mask 3 installed at a constant interval from the phosphor screen 4; and a mask frame 7 for fixing and supporting the shadow mask 3. The cathode ray tube also includes an inner shield 9 extending from the panel 1 to the funnel 2 for shielding external terrestrial magnetism and thus preventing deterioration of color purity by the magnetism; a stud pin 10 mounted at the inner side of the panel 1; a holder 18 connected to the stud pin 10 for elastically supporting the mask frame 7 to the panel 1; and a reinforcing band 11 arranged at an outer circumference of the panel 1 for distributing stress generated from the panel 1 and the funnel 2.

In the conventional cathode ray tube of the background art, the electron beam 6 emitted from the electron gun 12 is deflected by the deflection yoke 5, passes through a plurality of electron beam passing holes formed at the shadow mask 3, and lands on the phosphor screen 4 formed at the inner surface of the panel 1. Accordingly, the deflected electron beam 6 makes the phosphor formed at the phosphor screen emit light, thereby achieving an image.

FIGS. 2A, 2B, 2C, 2D, and 2E are views showing a fabrication process of a holder for a cathode ray tube in accordance with the background art. A fabrication process of the holder for a cathode ray tube of the background art will be explained in greater detail hereinafter.

As shown in FIGS. 2A and 2B, two materials having a different thermal expansion rate are bonded to each other in the order of a high thermal expansion portion 18*a*, a low thermal expansion portion 18*b*, and the high thermal expansion portion 18*a*, thereby forming a complete holder plate 180.

Then, as shown in FIGS. 2C and 2D, a punching process is performed on the holder plate 180 with a punch corresponding to a shape of each desired holder 18. At the same time, a piercing process is performed to form an engaging hole 18*c* for connecting to the stud pin 10, thereby fabricating the holder 18 having the engaging hole 18*c* with a constant shape.

Subsequently, as shown in FIG. 2E, a constant pressure is applied to bend the holder 18 with a predetermined angle to form a stud engaging portion 100 for engaging the stud pin 10 of the inner surface of the panel 1, a frame engaging portion 200 welded to the mask frame 7 so that the shadow mask 3 inside the panel 1 can be separated from the phosphor screen 4 at a predetermined interval, and a connecting portion 300 between the stud engaging portion 100 and the frame engaging portion 200.

In the cathode ray tube of the background art, visualized techniques such as resolution and image quality are limited. Rather, current trends focus on achieving a cathode ray tube having reduced costs, e.g., of elements in the cathode ray tube, and a cathode ray tube similar to a typical cathode ray tube of the background art.

However, when the holder 18 is fabricated by the above-described method, the holder 18 is formed by being punched separately at the holder plate 180. Accordingly, as shown in FIG. 3, the pair of holders 18 formed are not consistent with each other when engaged, so that remaining scrap portions are discarded without being used and waste of materials is increased. For example, the present inventors have determined that all of the material between opposing holders 18 (see FIG. 2C) is ultimately wasted during the fabrication process of the background art.

SUMMARY OF THE INVENTION

The present invention overcomes the shortcomings associated with the background art and achieves other advantages not realized by the background art.

Therefore, an object of the present invention is to provide a holder for a cathode ray tube, in which a pair of holders are integrally formed by an efficient punching and slitting process, e.g., that eliminates the unnecessary generation of scrap or waste material to reduce material cost An additional object of the present invention is to strengthen an engaging force between the holder and a stud pin, and thus to improve noise generated by external vibration with the apparatus and fabrication method of the present invention.

One or more of these and other objects are accomplished by a holder for a cathode ray tube comprising a stud engaging portion having an edge for engaging a stud and an engaging hole capable of engaging a stud pin mounted inside a panel; a frame engaging portion having a frame engaging edge engaged with a mask frame which supports a shadow mask along the frame engaging edge; and a connecting portion for connecting the stud engaging portion and the frame engaging portion, wherein, a length of the edge for the stud engaging portion is approximately equal to a length of the frame engaging edge of the frame engaging portion.

One or more of these and other objects are accomplished by a cathode ray tube comprising a panel and a funnel engaged with the panel and forming a vacuum space; a phosphor screen formed along an inner surface of the panel;

an electron gun; a shadow mask supported by a shadow mask frame; at least two holders for supporting the shadow mask frame, wherein each of the holders includes a stud engaging portion having an edge for engaging a stud and an engaging hole capable of engaging a stud pin mounted inside the panel; a frame engaging portion having a frame engaging edge engaged with the mask frame which supports the shadow mask along the frame engaging edge; and a connecting portion for connecting the stud engaging portion and the frame engaging portion, wherein, a length of the edge for the stud engaging portion is approximately equal to a length of the frame engaging edge of the frame engaging portion.

One or more of these and other objects are accomplished by a pair of holders for a cathode ray tube, each holder of the pair of holders comprising a stud engaging portion having an engaging hole capable of engaging a stud pin mounted inside a panel; a frame engaging portion capable of engaging a mask frame supporting a shadow mask; and a connecting portion for connecting the stud engaging portion and the frame engaging portion, wherein the connecting portion has a constant width with respect to a longitudinal direction of the holder, and wherein an overall width of the pair of holders in a state in which lower end surfaces of each of the holders are fully contacted with each other is equal to a sum of each width of the connecting portions of each holder.

One or more of these and other objects are accomplished by a method for fabricating a holder for a cathode ray tube having a stud engaging portion having an engaging hole capable of engaging a stud pin mounted inside a panel, a frame engaging portion capable of engaging a mask frame supporting a shadow mask; and a connecting portion for connecting the stud engaging portion and the frame engaging portion, the method for fabricating the holder comprising the steps of a first step of forming the engaging hole of the holder in a holder plate and bending a third bending portion in a direction parallel to a longitudinal direction of the holder plate; a second step of slitting a middle portion of the holder plate in the longitudinal direction along a parting line; a third step of forming a first bending portion between the stud engaging potion of the holder and the connecting portion and forming a second bending portion between the connecting portion and the frame engaging portion; and a fourth step of cutting the holder plate for dividing the holder plate into the plurality of holders.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 4:
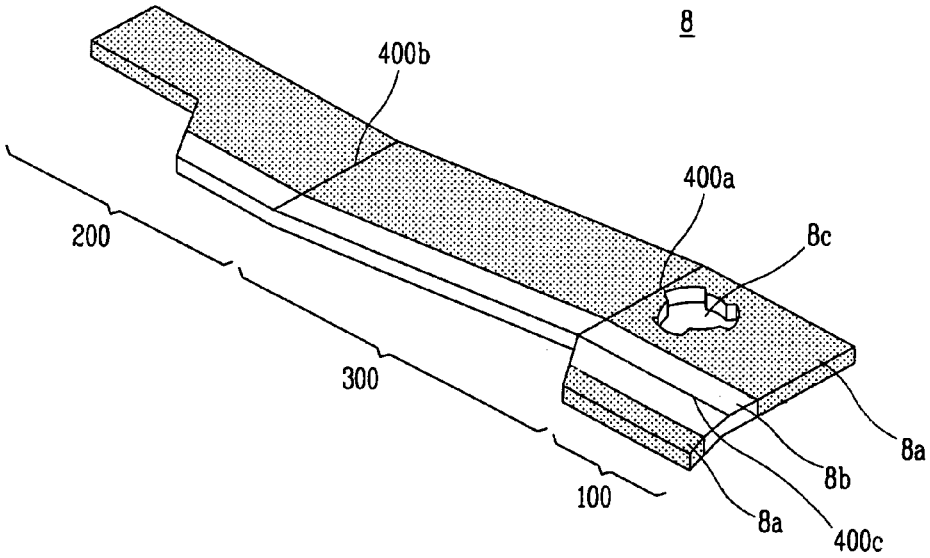
FIG. 4 is a view showing a shape of a holder for a cathode ray tube according to an embodiment of the present invention.
Figure 5:
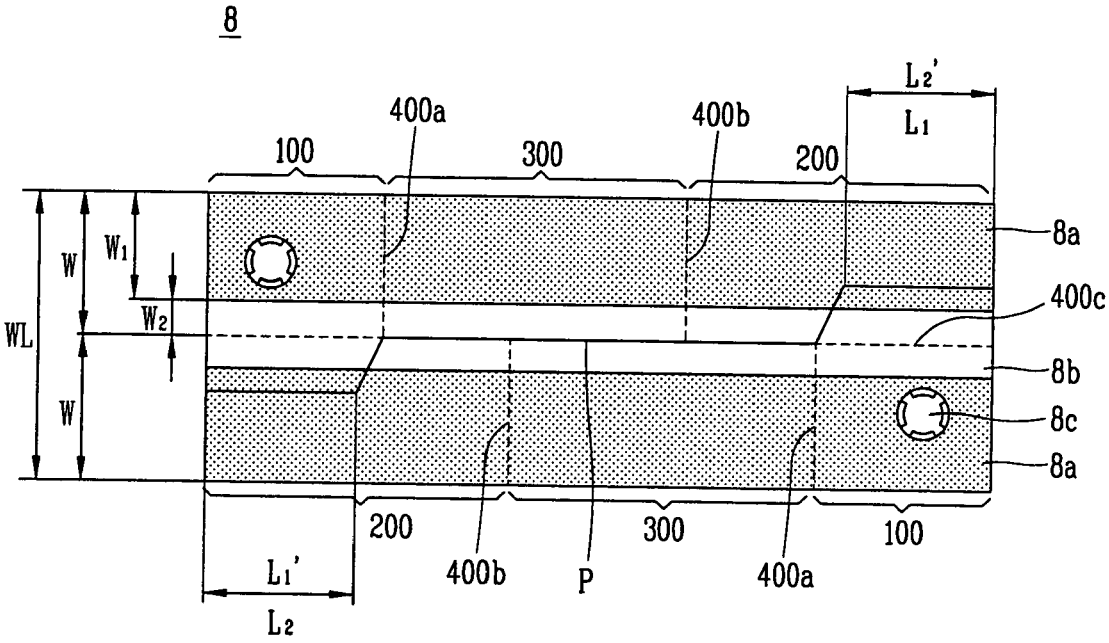
FIG. 5 is a view showing each lower end surface of a respective holder for a cathode ray tube of the present invention arranged facing to each other.
Figure 6:
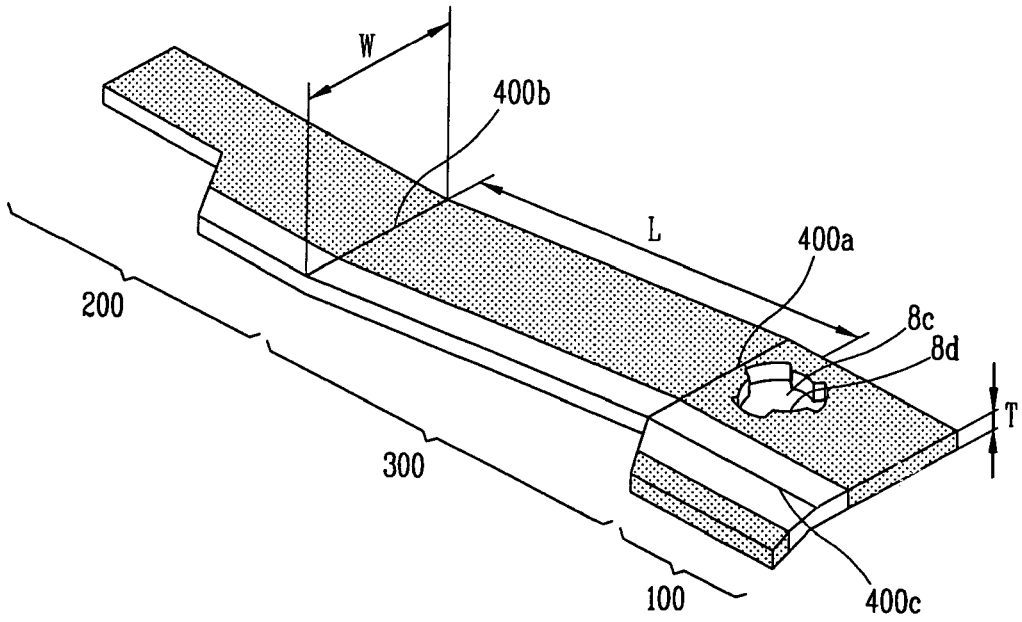
FIG. 6 is a view showing an individual holder for a cathode ray tube according to an embodiment of the present invention.

Reference will now be made in detail to the preferred embodiments of the present invention, examples of which are illustrated in the accompanying drawings. FIG. 4 is a view showing a shape of a holder for a cathode ray tube according to an embodiment of the present invention. FIG. 5 is a view showing each lower end surface of a respective holder for a cathode ray tube of the present invention arranged facing to each other. FIG. 6 is a view showing an individual holder for a cathode ray tube according to an embodiment of the present invention. FIGS. 7A, 7B, 7C, 7D, 7E, 7F, and 7G are views showing a fabrication process of the holder for a cathode ray tube according to an embodiment of the present invention. FIGS. 8A and 8B are views showing a holder for a cathode ray tube engaged with a shadow mask assembly according to an embodiment of the present invention.

As shown in FIG. 4, a holder 8 for a cathode ray tube includes a stud engaging portion 100 having an engaging hole 8*c* in order to be engaged to a stud pin mounted at an inner side of a panel of the cathode ray tube; a frame engaging portion 200 engaged to a mask frame which supports a shadow mask; and a connecting portion 300 for connecting the stud engaging portion 100 and the frame engaging portion 200.

In order to prevent scrap generation and reduce a fabrication cost, as shown in FIG. 5, the plurality of holders 8 mounted at the mask frame are detached therefrom and then lower end surfaces of the pair of holders 8 are arranged with facing to each other while the lower end surfaces of the pair of holders 8 are substantially contacted with each other.

That is, a width W of the connecting portion 300 of the holder 8 is formed equally along the longitudinal direction of the connecting portion 300, and in a state that the lower end surfaces are faced to each other, the entire width WL of the pair of holders 8 is equal to a sum of width W of the connecting portion 300 of each holder 8.

Figure 1:
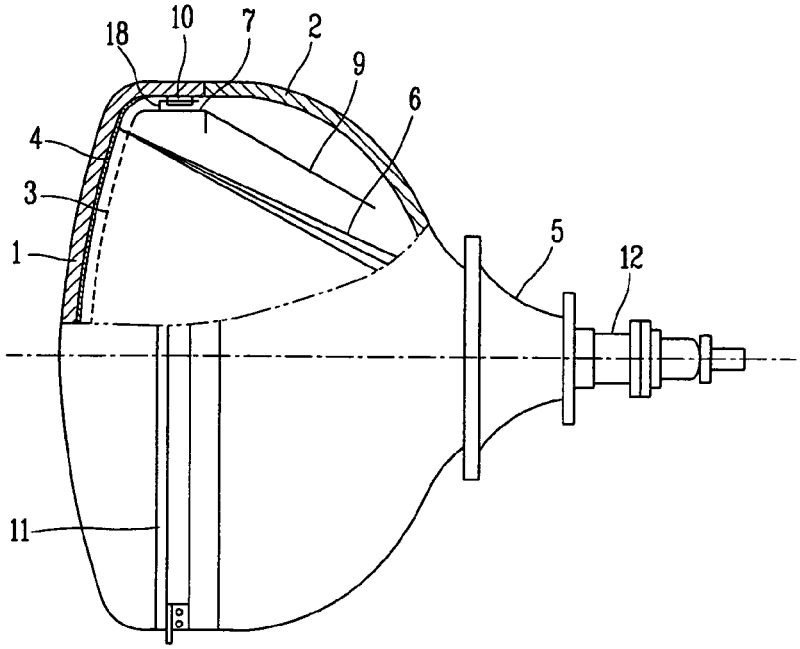
FIG. 1 BACKGROUND ART
FIG. 1 is a schematic view showing an example of a cathode ray tube of the background art.
Figure 2A:
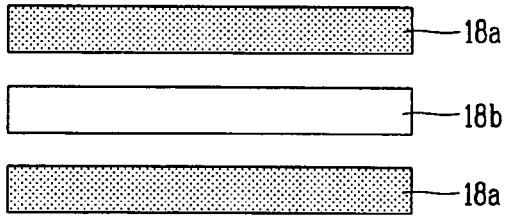
FIG. 2A BACKGROUND ART
FIGS. 2A, 2B, 2C, 2D, and 2E are views showing a fabrication process of a holder for a cathode ray tube of the background art.
Figure 2B:
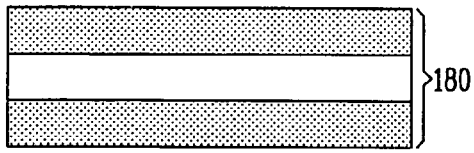
FIG. 2B BACKGROUND ART
Figure 2C:
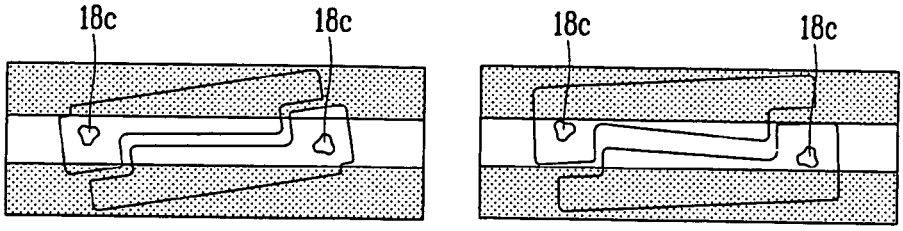
FIG. 2C BACKGROUND ART
Figure 2D:
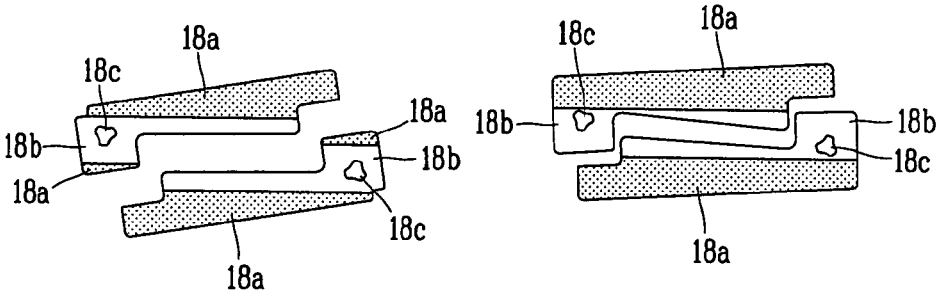
FIG. 2D BACKGROUND ART
Figure 2E:
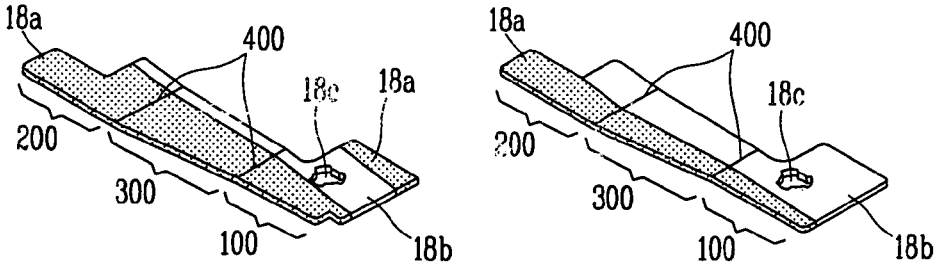
FIG. 2E BACKGROUND ART
Figure 3:
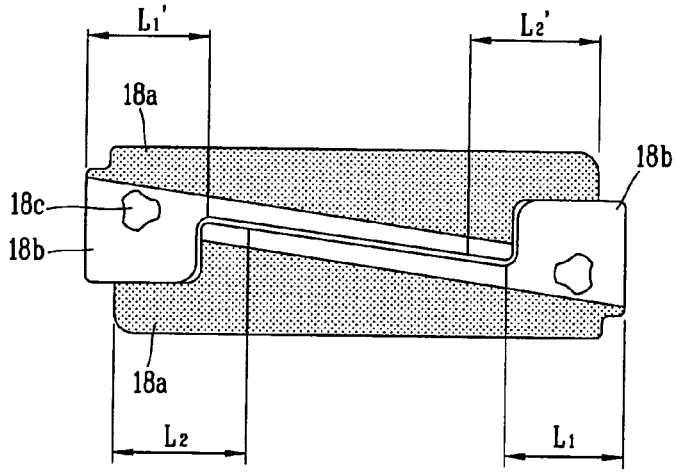
FIG. 3 BACKGROUND ART
FIG. 3 is a view showing a shape of a holder for a cathode ray tube of the background art.

As seen in FIG. 3, the resulting holders 18 of the background art have frame and stud engaging portions with lengths L, and $L_1'$ corresponding to the engaging holes 18*c* that are not equal to the lengths $L_2$ and $L_2'$ corresponding to the frame engaging portion 200 side of the holder 18. Accordingly, the pair of engaging holders 18 appear offset to one another along their respective lengths in FIG. 3.

As seen in FIG. 5, each holder is formed with frame engaging portions 200 and stud engaging portions 100 having edges that include lengths $L_2$, $L_2'$ and $L_1$, $L_1'$ that are equal to one another, respectively. In addition, the lengths, $L_1$, $L_1'$, $L_2$, and $L_2'$ of the edges shown in FIG. 5 represent portions of the common parting line P used to form the pair of holders 8 shown in FIG. 5.

Also, the holder preferably has a structure that a high thermal expansion portion 8*a* and a low thermal expansion portion 8*b* are composite. For example, two materials having different thermal expansion rate form the high thermal expansion portion 8*a* and the low thermal expansion portion 8*b* in the parallel direction to the lower end surface of the holder 8, thereby not generating scrap in a fabricating processes of the holder 8.

Also, the stud engaging portion 100 of the holder has a structure that the high thermal expansion portion 8*a*, the low thermal expansion portion 8*b*, and the high thermal expansion portion 8*a* are composite. The connecting portion 300 and the frame engaging portion 200 have a structure that the high thermal expansion portion 8*a* and the low thermal expansion portion 8*b* are composite.

Since the high thermal expansion portion 8*a* and the low thermal expansion portion 8*b* are formed in the parallel direction to an extension line of the lower end surface of the connecting portion 300, a width $W_1$ of the high thermal expansion portion 8*a* and a width $W_2$ of the low thermal expansion portion 8*b* are equal along the longitudinal direction of the connecting portion 300.

At this time, the high thermal expansion portion 8*a* of the holder is formed of a material of (SUS based) stainless steel alloy having an excellent elasticity, and the low thermal expansion portion 8*b* is formed of invar alloy, thereby constructing a bimetal holder of different materials.

Also, a first bending portion 400*a* is formed between the stud engaging portion 100 and the connecting portion 300, a second bending portion 400*b* is formed between the connecting portion 300 and the frame engaging portion 200, a third bending portion 400*c* is formed at the stud engaging portion 100 along a width direction of the stud engaging portion 100 towards a long edge of the holder 8 for connecting with the stud pin, and a bending line of the third bending portion 400*c* is formed substantially equally to the extension line of the lower end surface of the connecting portion 300.

The engaging hole 8*c* formed at the stud engaging portion 100 of the holder 8 is located at the upper side of the extension line of the lower end surface of the connecting portion 300, and is biased towards the connecting portion 300 from the center of the stud engaging portion 100.

The reason why the engaging hole 8*c* is formed at said position is to strengthen an engaging force between the stud pin of the inner surface of the panel and the holder 8.

The engaging force U is described by the following equation:

$$U=(D\times E\times W\times T^3)/4L^3 \quad (1)$$

In the above-described equation, U denotes an engaging force between the stud pin and the holder, L denotes a distance from the second bending portion 400*b* to the center of the engaging hole 8*c* formed in the stud engaging portion 100, D denotes displacement after force is applied to the center of the engaging hole 8*c* of the holder 8, E denotes an elastic coefficient of the material of the holder 8, and W denotes widths of the bending portions 400*a* and 400*b* of the holder, and the T denotes thickness of the holder.

In order to enhance the engaging force between the holder 8 and the stud pin, a material having a high elastic coefficient is preferably used. However, in this case, the material cost is increased. Therefore, in a piercing step for forming the engaging hole 8*c*, the engaging hole 8*c* is formed to be biased towards the connecting portion 300 from the center of the longitudinal direction of the stud engaging portion 100.

The engaging hole 8*c* of the stud engaging portion 100 is preferably formed at the high thermal expansion portion 8*a* having a wide width thus to be stably engaged to the stud pin. Also, in order to increase the engaging area with the stud pin, a burring portion 8*d* having a convexo-concave shape is formed at the inner circumference surface of the engaging hole 8*c*.

A fabrication method of the holder for a cathode ray tube according to the present invention is described in greater detail hereinafter.

Figure 7A:
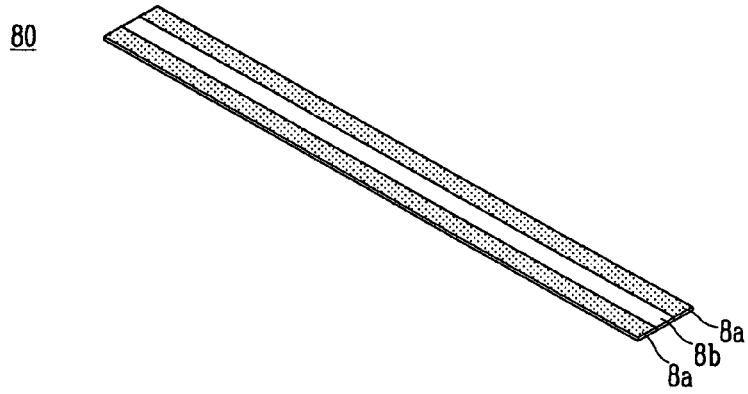
FIGS. 7A, 7B, 7C, 7D, 7E, 7F, and 7G are views showing a fabrication process of the holder for a cathode ray tube according to an embodiment of the present invention.
Figure 8A:
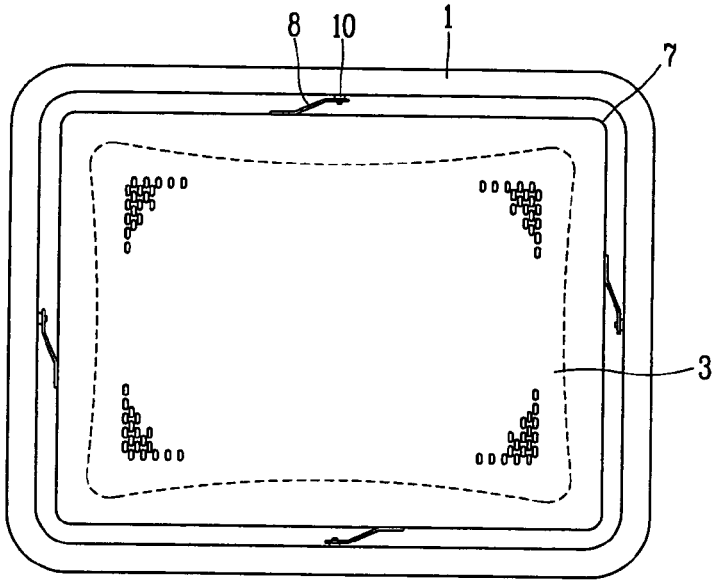
FIGS. 8A and 8B are views showing a holder for a cathode ray tube engaged with a shadow mask assembly according to an embodiment of the present invention.
Figure 8B:
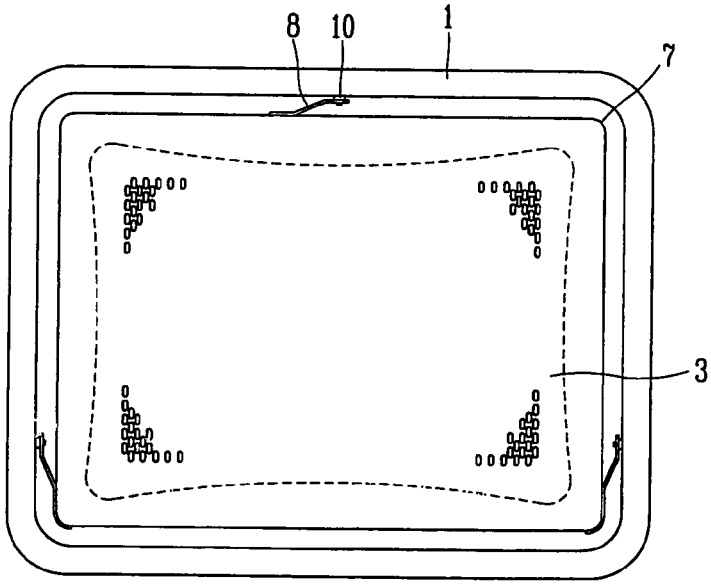

First, as shown in FIG. 7A, the two materials having different thermal expansion rate are bonded in parallel towards the longitudinal direction in an order of the high thermal expansion portion, the low thermal expansion portion, and the high thermal expansion portion, thereby forming the holder plate 80.

Figure 7B:
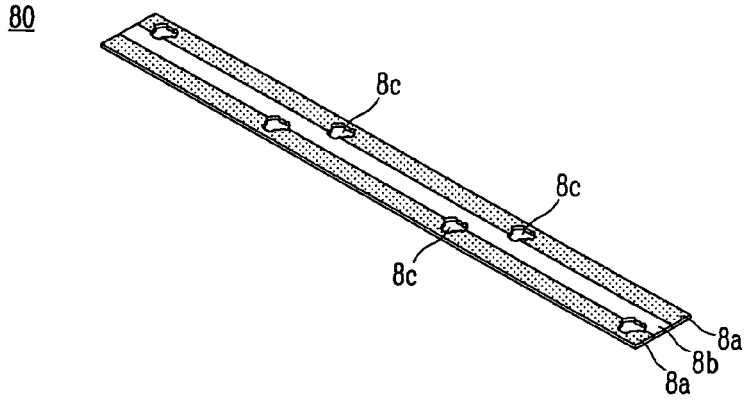
Figure 7C:
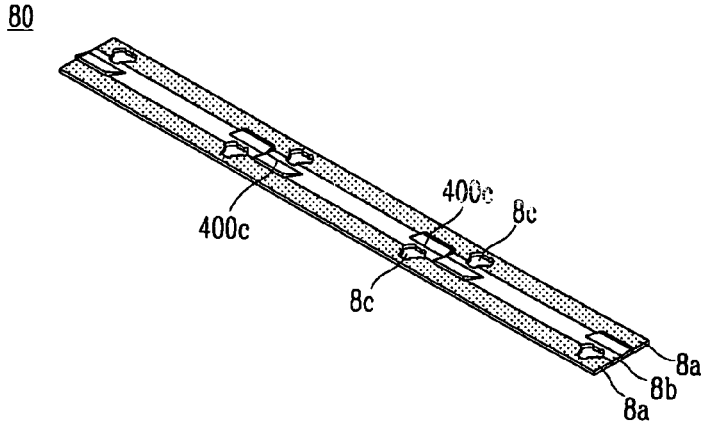

Also, as shown in FIGS. 7B and 7C, the engaging hole 8*c* is punched near the stud engaging portion of the holder and at the same time, the third bending portion 400*c* is bent in the parallel direction to the holder plate 80.

Figure 7D:
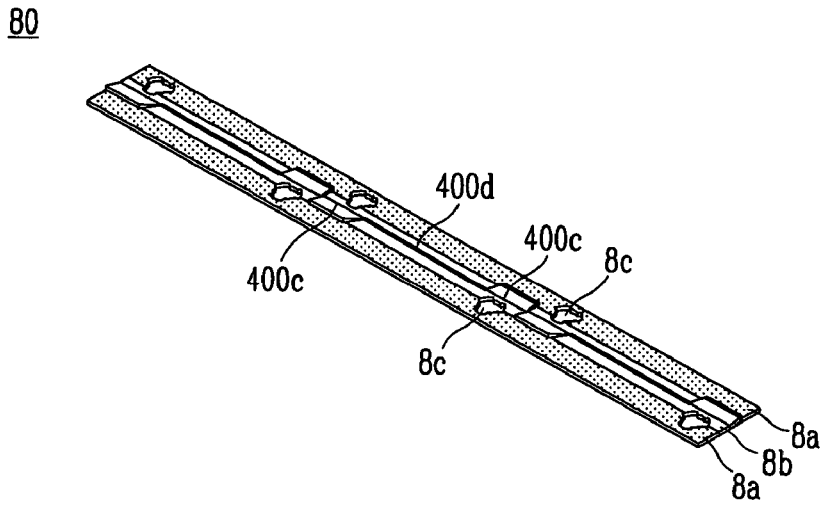
Figure 7E:
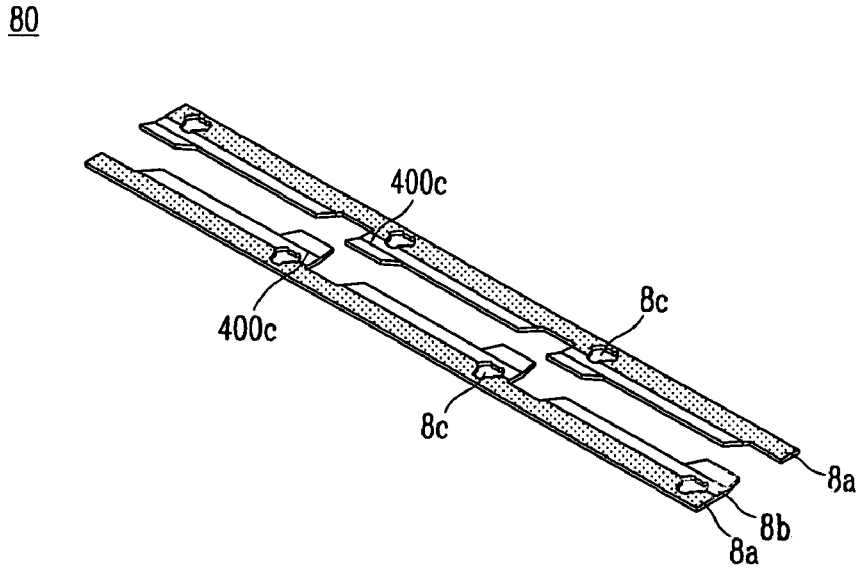
Figure 7F:
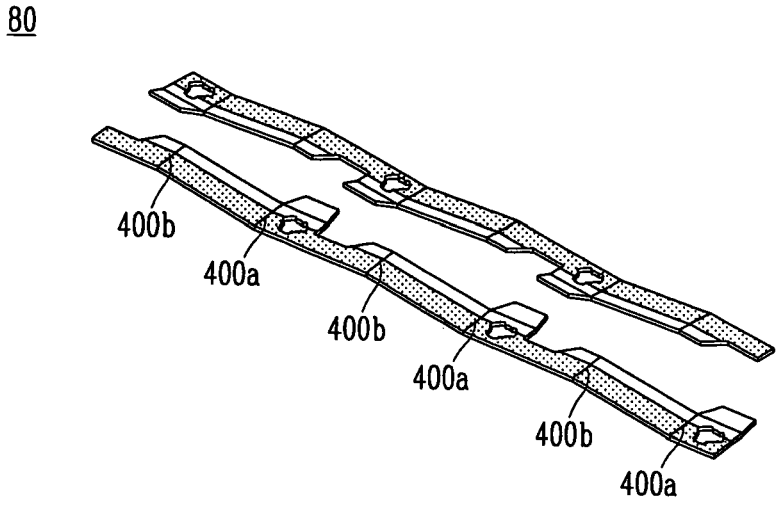
Figure 7G:
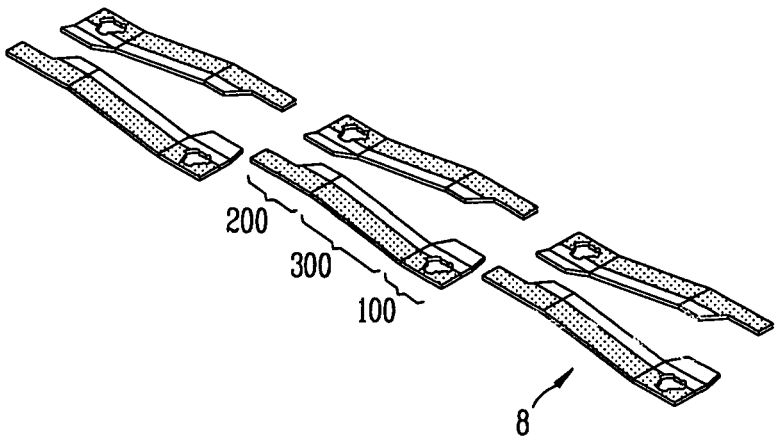

Then, as shown in FIGS. 7D and 7E, the step of slitting a middle part of the holder plate 80 towards the long edge thereof is performed, e.g., along the parting line P shown in FIG. 5. Also, as shown in FIG. 7F, the first bending portion 400*a* is formed between the stud engaging portion 100 and the connecting portion 300 of the holder 8, and the second bending portion 400*b* is formed between the connecting portion 300 and the frame engaging portion 200 of the holder 8. Finally, as shown in FIG. 7G, the holder plate 80 is cut and divided into a plurality of holders 8.

Preferably, after the slitting step, a surface treatment process on the slit portion 80*e* (i.e. the lower end portion of the connecting portion 300) are performed. More preferably, before the step of punching and forming the third bending portion, the burring portion 8*d* is formed so that the inner circumference surface of the engaging hole 8*c* can be bent to increase a contact area with the stud pin and thereby increase the engaging force.

At this time, the holder 8 has a structure that the high thermal expansion portion 8*a* and the low thermal expansion portion 8*b* having different thermal expansion rate are composite.

Also, the engaging hole 8*c* formed at the stud engaging portion 100 is formed to be biased towards the connecting portion 300 from a center of the stud engaging portion 100 in order to strengthen the engaging force between the stud pin and the holder 8, and the center of the engaging hole 8*c* is formed at the high thermal expansion portion 8*a*.

As shown in FIGS. 8A and 8B, the holder 8 corresponding to a component of the shadow mask assembly is connected to the stud pin 10 of the inner side of the panel 1 and welded to the mask frame 7 so that the inner surface of the panel 1 and the shadow mask 3 can maintain a constant interval, thereby supporting the shadow mask 3.

The holder for a cathode ray tube according to the present invention is punched, slit, and bent so that a pair of holder members can be integrally formed, thereby not generating unnecessary scrap in the fabrication processes of the holder. Accordingly, material cost is reduced as much as 15–50% over the conventional processes of the background art, and a supporting strength of the shadow mask is enhanced by increasing the engaging force of the holder.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A holder for a cathode ray tube comprising:

a stud engaging portion having a surface for engaging a stud and an engaging hole capable of engaging a stud pin mounted inside a panel;

a frame engaging portion having a frame engaging surface to be engaged with a mask frame which supports a shadow mask that has a narrow end portion with a predetermined length; and a connecting portion for connecting the stud engaging portion and the frame engaging portion, wherein, the stud engaging portion has two bending portions which are bent along lines that are substantially perpendicular to each other, and an edge not connected to said connecting portion that has a length which is approximately equal to the predetermined length of the narrow end portion of the frame engaging portion.

2. The holder according to claim 1, wherein a bending line of one of the bending portions is formed along an extension line of a lower end surface of the connecting portion.

3. The holder according to claim 1, wherein the engaging hole of the stud engaging portion is located along an upper side of an extension line of a lower end surface of one of the connecting portions.

4. The holder according to claim 3, wherein a bending line of the bending portion is formed along an extension line of the lower end surface of the connecting portion.

5. The holder according to claim 1, wherein the holder is formed of at least two materials.

6. The holder according to claim 5, wherein a first material of the holder has a high thermal expansion rate and a second material of the holder has a low thermal expansion rate.

7. The holder according to claim 6, wherein the first material is stainless steel alloy, and the second material is Fe—Ni alloy.

8. The holder according to claim 1, wherein a width of the connecting portion is constant with respect to a longitudinal direction of the connecting portion.

9. The holder according to claim 1, wherein a width of a high thermal expansion rate material and a width of a low thermal expansion rate material forming said connecting portion are respectively equal with respect to a longitudinal direction of the connecting portion.

10. A cathode ray tube comprising:

a panel and a funnel engaged with said panel and forming a vacuum space;

a phosphor screen formed along an inner surface of said panel;

an electron gun;

a shadow mask supported by a shadow mask frame;

at least two holders for supporting said shadow mask frame, wherein each of said holders includes a stud engaging portion having an engaging hole capable of engaging a stud pin mounted inside the panel;

a frame engaging portion capable of engaging the mask frame supporting the shadow mask that has a narrow end portion having a predetermined length; and a connecting portion for connecting the stud engaging portion and the frame engaging portion having a width that is substantially greater than the width of the narrow end portion of the frame engagement portion;

wherein, when an unbent pair of holders are arranged side-by-side and facing to each other so that the lower end surfaces thereof are fully aligned with and fully contacted with each other, the overall width of the pair of holders is equal to a sum of each width of the connecting portions of each holder.

11. The cathode ray tube according to claim 10, wherein a bending portion of said at least one holder is formed at the stud engaging portion for connecting with the stud pin.

12. The cathode ray tube according to claim 11, wherein a bending line of the bending portion is formed along an extension line of a lower end surface of the connecting portion.

13. The cathode ray tube according to claim 10, wherein the engaging hole of the stud engaging portion is located along an upper side of an extension line of a lower end surface of the connecting portion.

14. The cathode ray tube according to claim 10, wherein said at least one holder is formed of at least two materials.

15. The cathode ray tube according to claim 13, wherein a first material of the holder has a high thermal expansion rate and a second material of the holder has a low thermal expansion rate.

16. The cathode ray tube according to claim 10, further comprising at least four holders.

17. A pair of holders for a cathode ray tube, each holder of said pair of holders comprising:

a stud engaging portion having an engaging hole capable of engaging a stud pin mounted inside a panel;

a frame engaging portion capable of engaging a mask frame supporting a shadow mask that has a narrow end portion having a predetermined length; and a connecting portion for connecting the stud engaging portion and the frame engaging portion having a width that is substantially greater than the width of the narrow end portion of the frame engagement portion, wherein said connecting portion has a constant width with respect to a longitudinal direction of said holder, and wherein an overall width of the pair of holders in a state in which lower end surfaces of each of said holders are fully aligned with and side-by-side with each other and fully contacted with each other is equal to a sum of each width of the connecting portions of each holder.

18. The pair of holders according to claim 11, wherein a length of an edge for the stud engaging portion is approximately equal to a length of a frame engaging edge of the frame engaging portion.

* * * * *